US008177296B2

(12) United States Patent
Shih

(10) Patent No.: US 8,177,296 B2
(45) Date of Patent: May 15, 2012

(54) MOTORIZED ROCKING CHAIR MOVED IN A PENDULUM MANNER

(75) Inventor: Lung-Tan Shih, Changhua Hsien (TW)

(73) Assignee: Ruoey Lung Enterprise Corp., Changhua, Hsien (TW)

( * ) Notice: Subject to any disclaimer, the term of this patent is extended or adjusted under 35 U.S.C. 154(b) by 372 days.

(21) Appl. No.: 12/546,818

(22) Filed: Aug. 25, 2009

(65) Prior Publication Data

US 2011/0049963 A1 Mar. 3, 2011

(51) Int. Cl.
*A47C 1/031* (2006.01)

(52) U.S. Cl. ..... 297/85 M; 297/85 L; 297/260.2

(58) Field of Classification Search ..... 297/85 R, 297/85 L, 83, 86, 260.2, 273, 276–277, 279–281, 297/85 M
See application file for complete search history.

(56) References Cited

U.S. PATENT DOCUMENTS 3,758,156 A * 9/1973 Zawadzki ..... 297/260.2
4,333,681 A * 6/1982 Nelson ..... 297/83
4,572,573 A * 2/1986 Yoshikawa et al. ..... 297/75
4,591,205 A * 5/1986 James ..... 297/85 R
5,570,927 A * 11/1996 LaPointe et al. ..... 297/85 L
5,704,686 A * 1/1998 May ..... 297/281
5,790,997 A * 8/1998 Ruehl ..... 5/618
5,806,920 A * 9/1998 Blount ..... 297/68
6,059,367 A * 5/2000 Rogers ..... 297/423.1
6,074,011 A * 6/2000 Ptak et al. ..... 297/408
6,106,062 A * 8/2000 Ambrose et al. ..... 297/281
6,120,095 A * 9/2000 Rogers ..... 297/273
6,406,095 B1 * 6/2002 Bouchard et al. ..... 297/281
6,692,078 B2 * 2/2004 Pham et al. ..... 297/423.2
6,761,405 B2 * 7/2004 Bellefleur ..... 297/270.1
6,910,740 B2 * 6/2005 Baker et al. ..... 297/408
6,929,320 B2 * 8/2005 Laurent ..... 297/83
6,974,186 B1 * 12/2005 Chang ..... 297/68
7,543,885 B2 * 6/2009 Pollard et al. ..... 297/85 R

* cited by examiner

*Primary Examiner* — David Dunn
*Assistant Examiner* — Erika Garrett
(74) *Attorney, Agent, or Firm* — Alan Kamarth; Kamrath IP Lawfirm, PA

(57) ABSTRACT

A motorized rocking chair includes a support frame, a seat pivotally mounted on the support frame, an actuating mechanism mounted between the support frame and the seat to drive the seat to move relative to the support frame, a backrest pivotally mounted on the seat, and a telescopic mechanism mounted between the seat and the backrest to drive the backrest to move relative to the seat. Thus, the actuating mechanism is controlled by an electrically control device to drive the seat to pivot relative to the support frame reciprocally in a pendulum manner so that the seat is pivoted relative to the support frame automatically. In addition, the telescopic mechanism is controlled by the electrically control device to adjust the inclined angle of the backrest so as to provide a comfortable sensation to the user.

18 Claims, 11 Drawing Sheets

MOTORIZED ROCKING CHAIR MOVED IN A PENDULUM MANNER

BACKGROUND OF THE INVENTION

1. Field of the Invention

The present invention relates to a rocking chair and, more particularly, to a motorized rocking chair that is operated by an electric power.

2. Description of the Related Art

A conventional rocking chair comprises a chair body and a substantially arc-shaped support bracket mounted on a bottom of the chair body. Thus, when a user applies a force on the chair body by his/her own gravity, the support bracket functions as a rocking fulcrum of the chair body so that the rocking chair is rocked forward and backward. However, the user has to exert a force on the chair body so as to rock the rocking chair, so that the user seated on the rocking chair cannot relax himself/herself, thereby easily causing an uncomfortable sensation to the user.

BRIEF SUMMARY OF THE INVENTION

In accordance with the present invention, there is provided a motorized rocking chair, comprising a support frame, a seat pivotally mounted on the support frame, an actuating mechanism mounted between the support frame and the seat to drive the seat to move relative to the support frame, a backrest pivotally mounted on the seat, and a telescopic mechanism mounted between the seat and the backrest to drive the backrest to move relative to the seat.

The primary objective of the present invention is to provide a motorized rocking chair that is moved in a pendulum manner.

According to another objective of the present invention, the actuating mechanism is controlled by the electrically control device to drive the seat to pivot relative to the support frame reciprocally in a pendulum manner so that the seat is pivoted relative to the support frame automatically, and the user needs not to rock the seat manually.

According to a further objective of the present invention, the telescopic mechanism is controlled by the electrically control device to adjust the inclined angle of the backrest and the foot support according to the user's requirement so as to provide a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
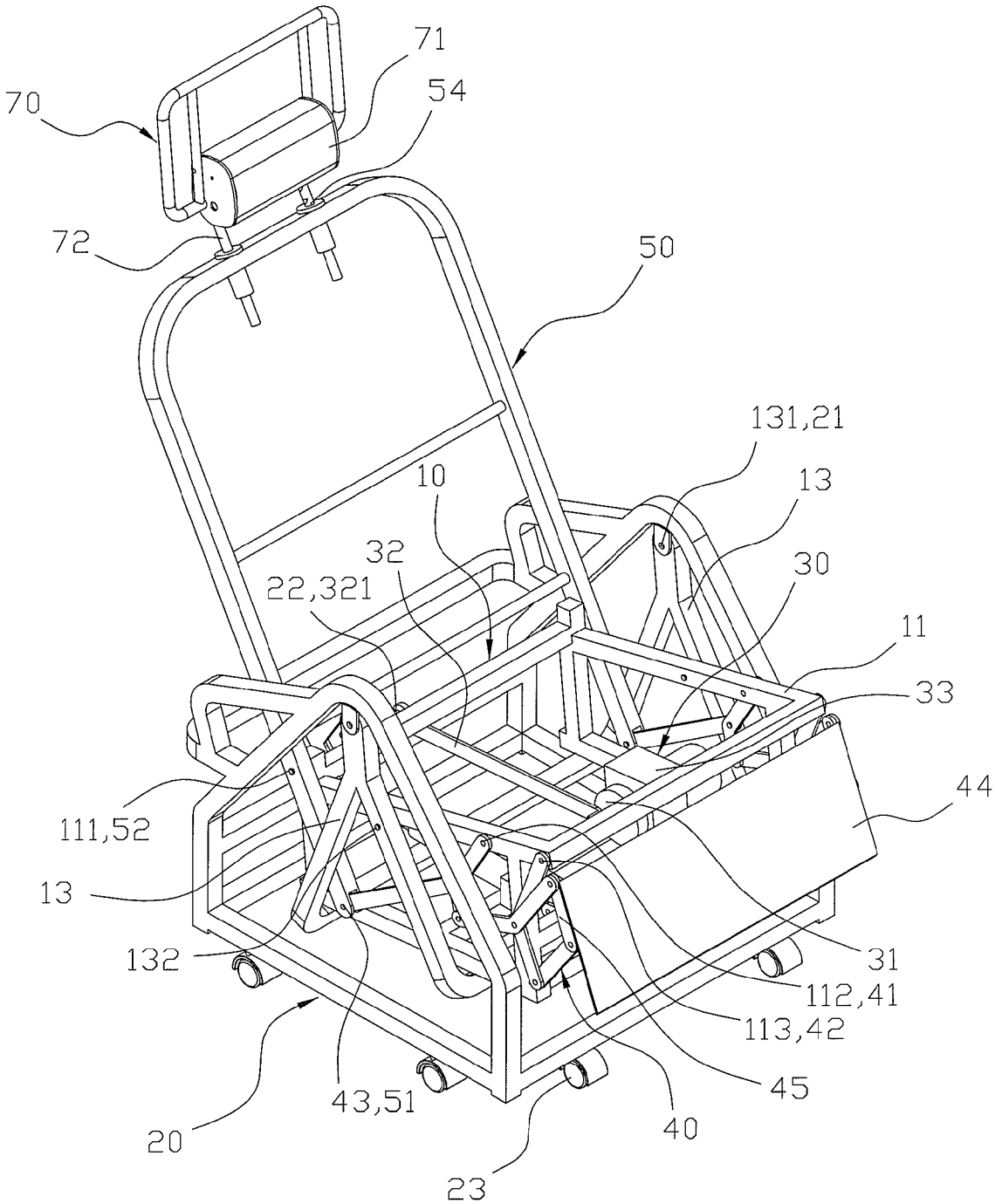
FIG. 1 is a perspective view of a motorized rocking chair in accordance with the preferred embodiment of the present invention.
Figure 2:
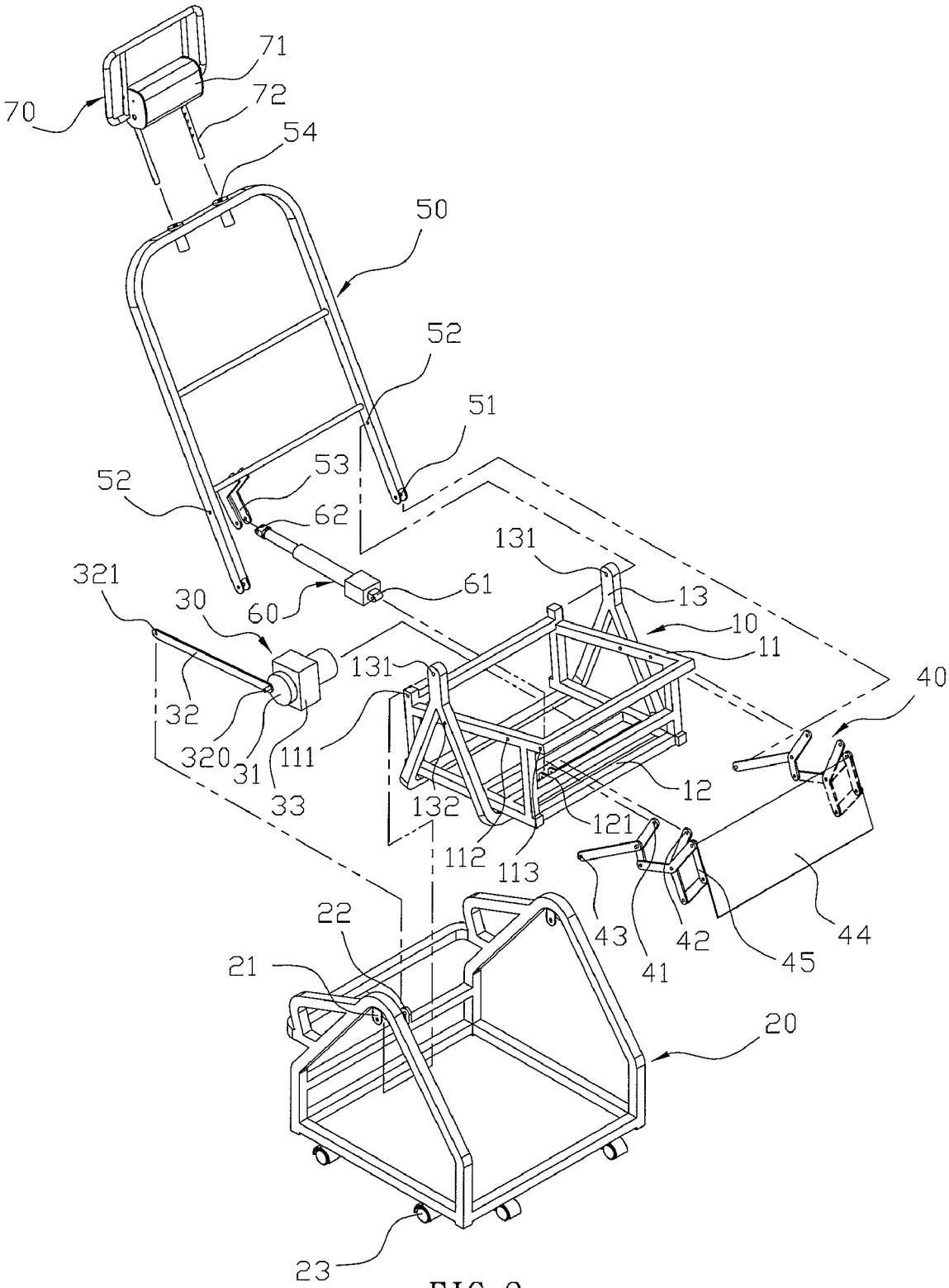
FIG. 2 is an exploded perspective view of the motorized rocking chair as shown in FIG. 1.
Figure 3:
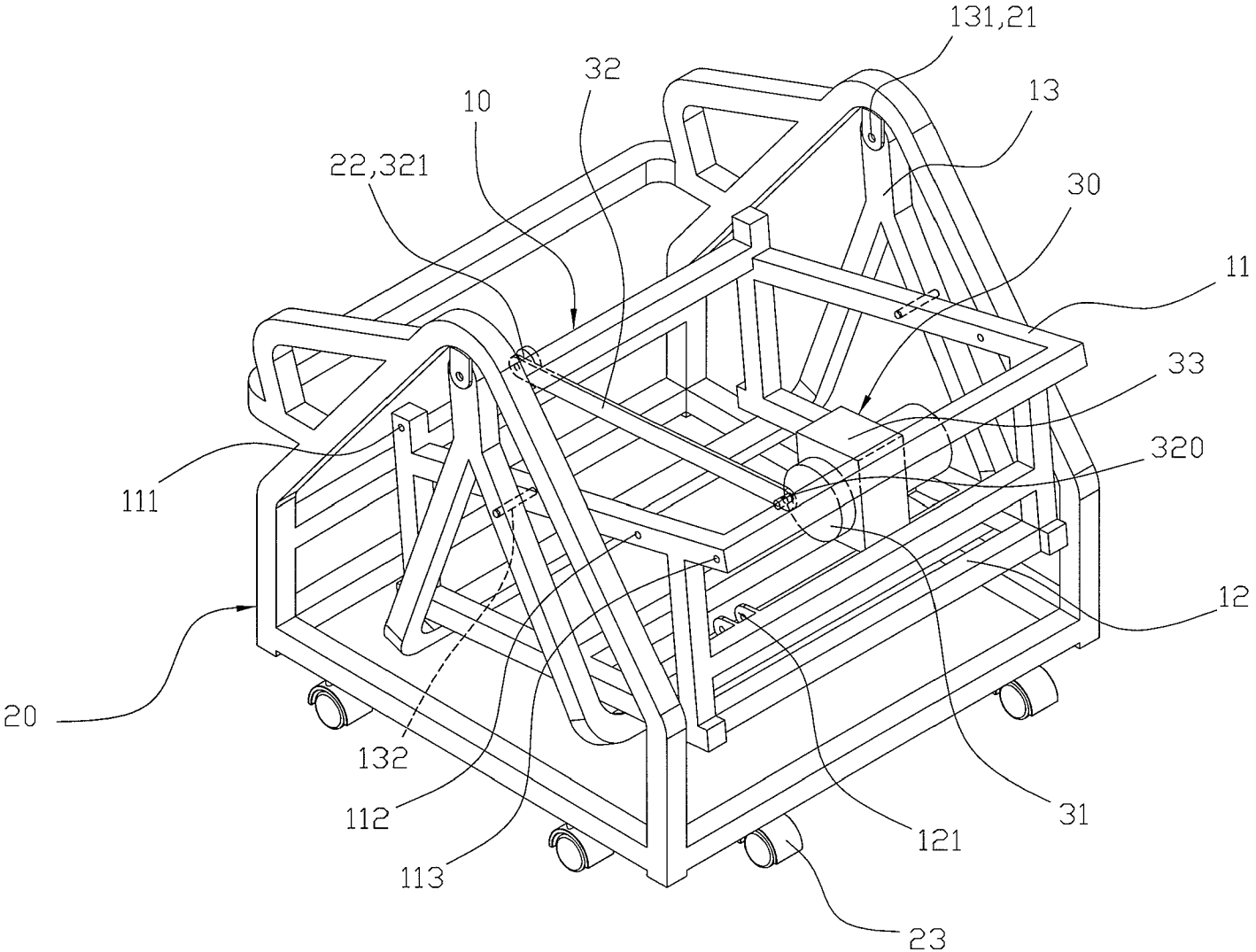
FIG. 3 is a partially perspective view of the motorized rocking chair as shown in FIG. 1.
Figure 4:
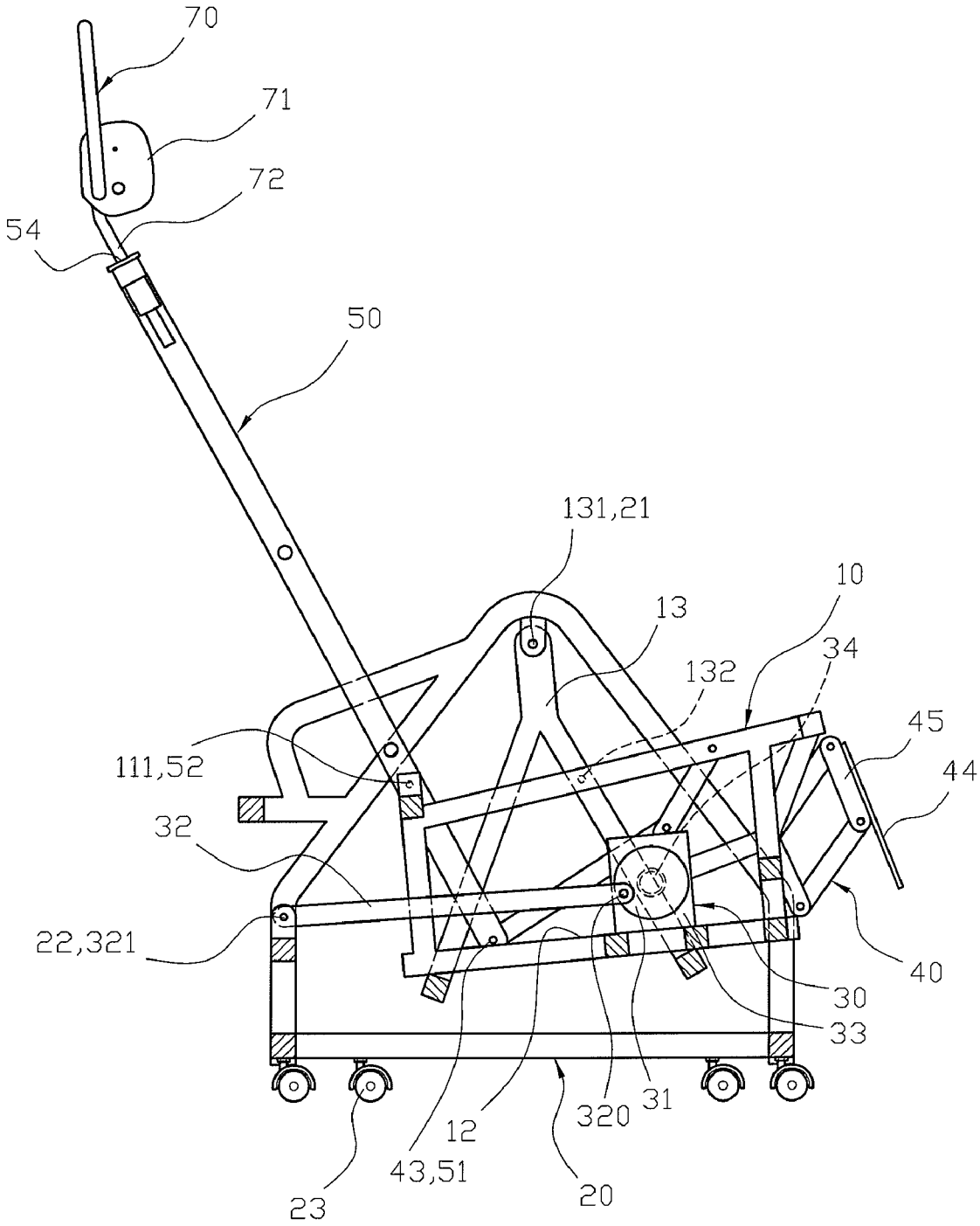
FIG. 4 is a side cross-sectional view of the motorized rocking chair as shown in FIG. 1.

Referring to the drawings and initially to FIGS. 1-5, a motorized rocking chair in accordance with the preferred embodiment of the present invention comprises a support frame 20, a seat 10 pivotally mounted on the support frame 20, an actuating mechanism 30 mounted between the support frame 20 and the seat 10 to drive the seat 10 to move relative to the support frame 20, a backrest 50 pivotally mounted on the seat 10, a telescopic mechanism 60 mounted between the seat 10 and the backrest 50 to drive the backrest 50 to move relative to the seat 10, a head support 70 mounted on the backrest 50, two link mechanisms 40 each mounted between the seat 10 and the backrest 50 to move in concert with the backrest 50, and a foot support 44 mounted between the two link mechanisms 40 to move in concert with the two link mechanisms 40.

The support frame 20 has an upper end provided with two opposite pivot ears 21 and a lower end provided with a plurality of castors 23. The support frame 20 has a rear end provided with a stop portion 22.

The motorized rocking chair further comprises two suspension arms 13 each secured on the seat 10 and each pivotally mounted on the support frame 20, and at least two reinforcing members 132 located between the seat 10 and the two suspension arms 13 respectively to enhance the structural strength of the seat 10. Each of the two suspension arms 13 extends upwardly from the seat 10 and has an upper end provided with a pivot portion 131 pivotally mounted on a respective one of the pivot ears 21 of the support frame 20.

The seat 10 is pivotable relative to the support frame 20 in a pendulum manner. The seat 10 and has an upper portion 11 and a lower portion 12. The upper portion 11 of the seat 10 has a front end provided with two first through holes 112 and second through holes 113 and a rear end provided with two through bores 111. The lower portion 12 of the seat 10 has a side provided with a support base 121.

The actuating mechanism 30 includes a drive member 33 secured on the lower portion 12 of the seat 10, a rotation member 31 rotatably mounted on the drive member 33, and a drive lever 32 having a first end 320 pivotally connected with the rotation member 31 to move in concert with the rotation member 31 and a second end 321 pivotally connected with the stop portion 22 of the support frame 20. The drive member 33 of the actuating mechanism 30 is a drive motor to rotate the rotation member 31. The rotation member 31 of the actuating mechanism 30 has a disk shape. The first end 320 of the drive lever 32 is arranged on the rotation member 31 eccentrically and is deviated from a central shaft 34 of the rotation member 31.

The two link mechanisms 40 are located at two opposite sides of the seat 10 symmetrically. Each of the two link mechanisms 40 has a mediate portion provided with a first pivot hole 41 pivotally connected with a respective one of the first through holes 112 of the seat 10 and a second pivot hole 42 pivotally connected with a respective one of the second through holes 113 of the seat 10. Each of the two link mechanisms 40 has a first end provided with a driven portion 43 that is movable in concert with the backrest 50 and a second end provided with a support portion 45 that is movable in concert with the driven portion 43. The foot support 44 is mounted between the support portions 45 of the two link mechanisms 40.

The backrest 50 has a lower end provided with two pivot bores 52 each pivotally connected with a respective one of the through bores 111 of the seat 10 and two push portions 51 each pivotally connected with the driven portion 43 of a respective one of the two link mechanisms 40. Each of the two pivot bores 52 of the backrest 50 is located above each of the two push portions 51. The backrest 50 has an upper end provided with two mounting sleeves 54. The backrest 50 has a side provided with a drive arm 53 which is substantially V-shaped.

The telescopic mechanism 60 has a first portion 61 pivotally connected with the support base 121 of the seat 10 and a second portion 62 retractably mounted in the first portion 61 and pivotally connected with the drive arm 53. Preferably, the drive arm 53 has an upper end secured on the backrest 50 and a lower end pivotally connected with the second portion 62 of the telescopic mechanism 60. Thus, when the second portion 62 of the telescopic mechanism 60 is moved relative to the first portion 61 of the telescopic mechanism 60, the drive arm 53 is moved in concert with the second portion 62 of the telescopic mechanism 60 to drive the backrest 50 to pivot relative to the seat 10.

The head support 70 includes a resting cushion 71 and two adjusting rods 72 each mounted on a bottom of the resting cushion 71 and each adjustably mounted in a respective one of the mounting sleeves 54 of the backrest 50.

Figure 5:
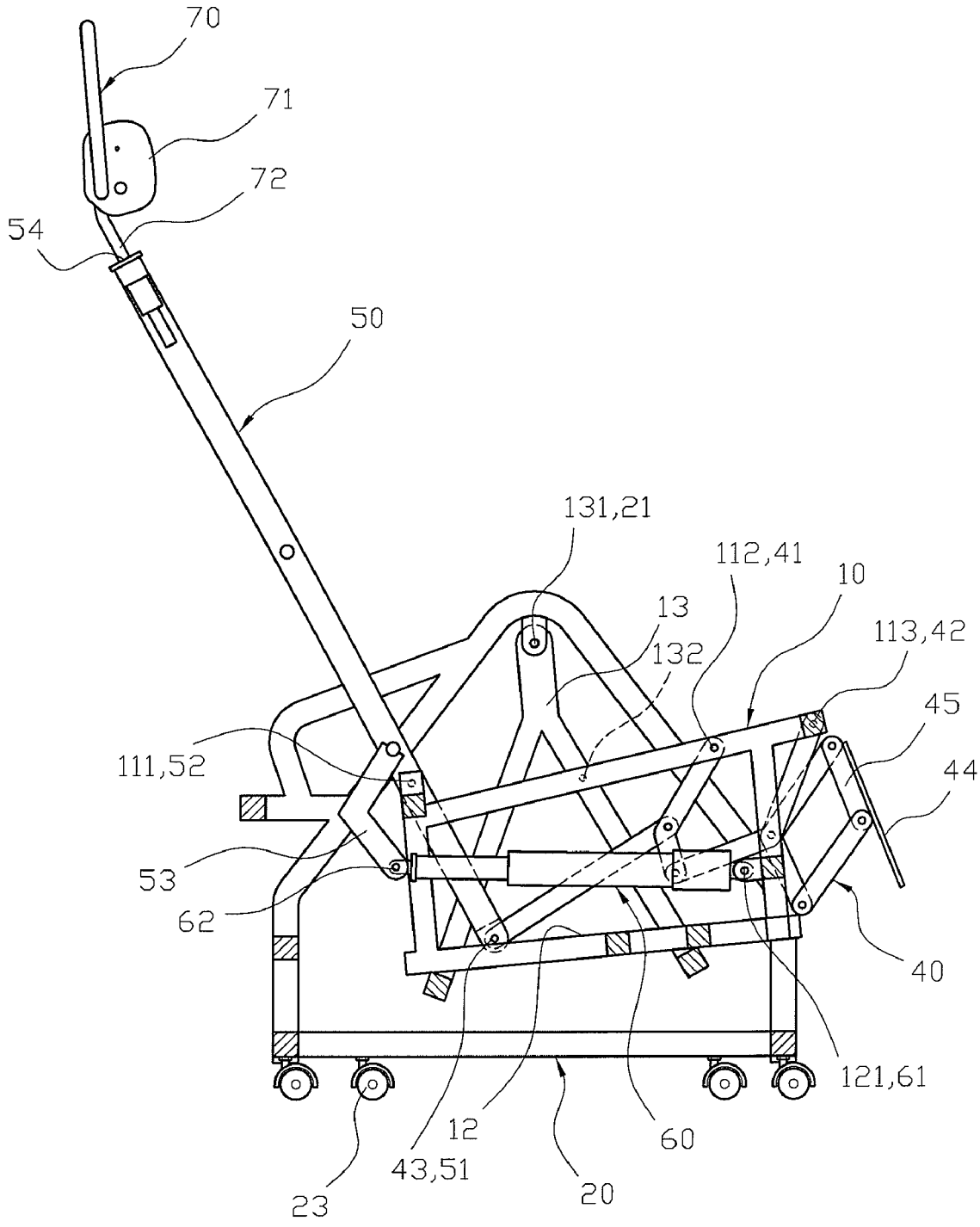
FIG. 5 is a side cross-sectional view of the motorized rocking chair as shown in FIG. 1.
Figure 6:
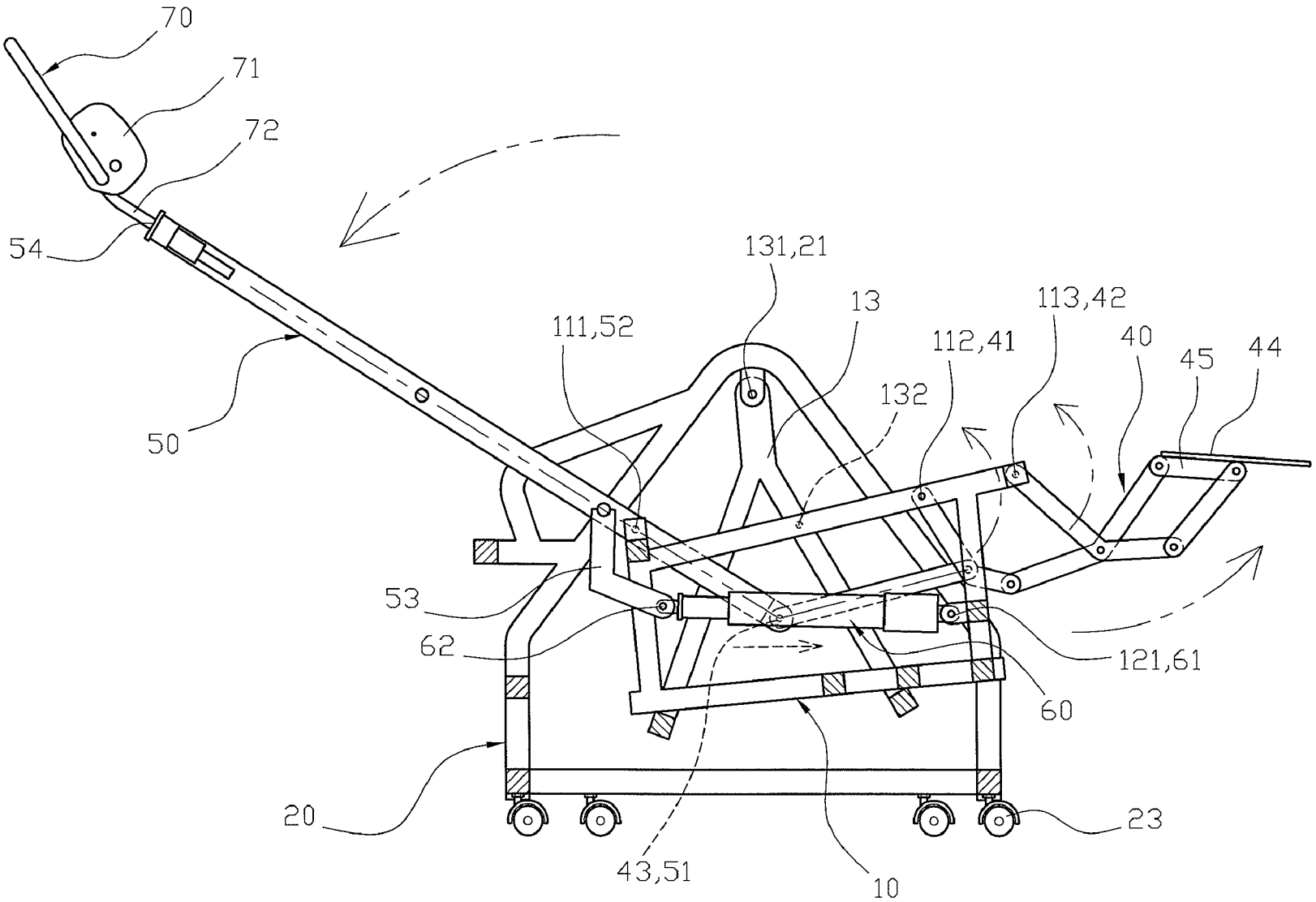
FIG. 6 is a schematic operational view of the motorized rocking chair as shown in FIG. 5.

In adjustment, referring to FIGS. 5 and 6 with reference to FIGS. 1-4, when the second portion 62 of the telescopic mechanism 60 is moved toward the first portion 61 of the telescopic mechanism 60 as shown in FIG. 6, the drive arm 53 is moved in concert with the second portion 62 of the telescopic mechanism 60 to drive the backrest 50 to pivot downward relative to the seat 10, so that the pivot bores 52 of the backrest 50 are pivoted about the through bores 111 of the seat 10, and the backrest 50 is moved rearward and downward. At the same time, when the backrest 50 is moved relative to the seat 10, the driven portion 43 of each of the two link mechanisms 40 is pushed by the respective push portion 51 of the backrest 50 to drive each of the two link mechanisms 40 to pivot forward relative to the seat 10, so that the support portion 45 of each of the two link mechanisms 40 is moved forward and upward, and the foot support 44 is also is moved forward and upward until the foot support 44 is disposed at a horizontal state as shown in FIG. 6. In such a manner, the inclined angle of the backrest 50 and the foot support 44 is adjusted by operation of the telescopic mechanism 60 according to the user's requirement so as to provide a comfortable sensation to the user.

On the contrary, when the second portion 62 of the telescopic mechanism 60 is moved outward relative to the first portion 61 of the telescopic mechanism 60 as shown in FIG. 5, the drive arm 53 is moved in concert with the second portion 62 of the telescopic mechanism 60 to drive the backrest 50 to pivot upward relative to the seat 10, so that the pivot bores 52 of the backrest 50 are pivoted about the through bores 111 of the seat 10, and the backrest 50 is moved forward and upward. At the same time, when the backrest 50 is moved relative to the seat 10, the driven portion 43 of each of the two link mechanisms 40 is pulled by the respective push portion 51 of the backrest 50 to drive each of the two link mechanisms 40 to pivot rearward relative to the seat 10, so that the support portion 45 of each of the two link mechanisms 40 is moved rearward and downward, and the foot support 44 is also is moved rearward and downward so as to fold the foot support 44 as shown in FIG. 5.

Figure 7:
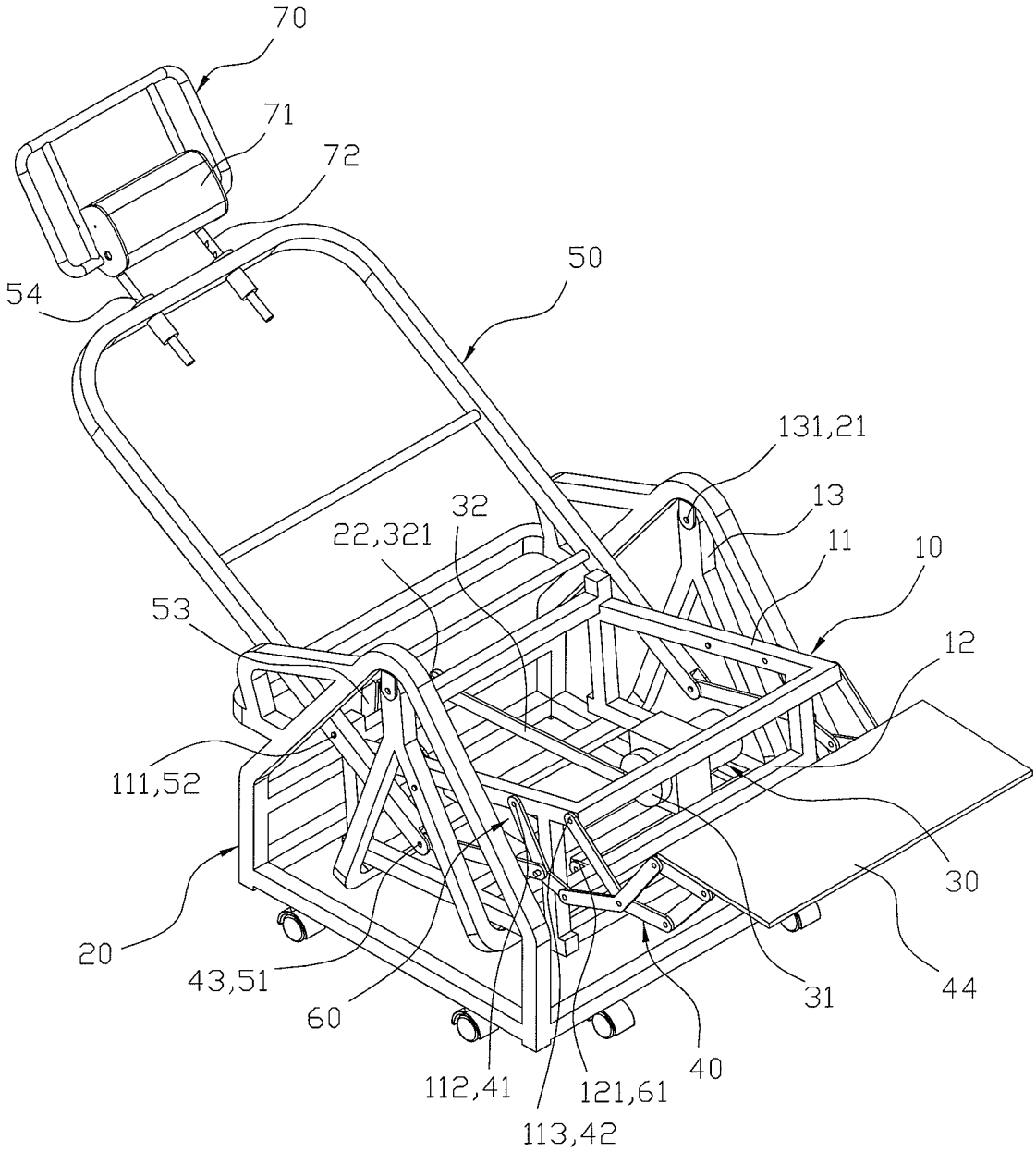
FIG. 7 is a schematic operational view of the motorized rocking chair as shown in FIG. 1.
Figure 8:
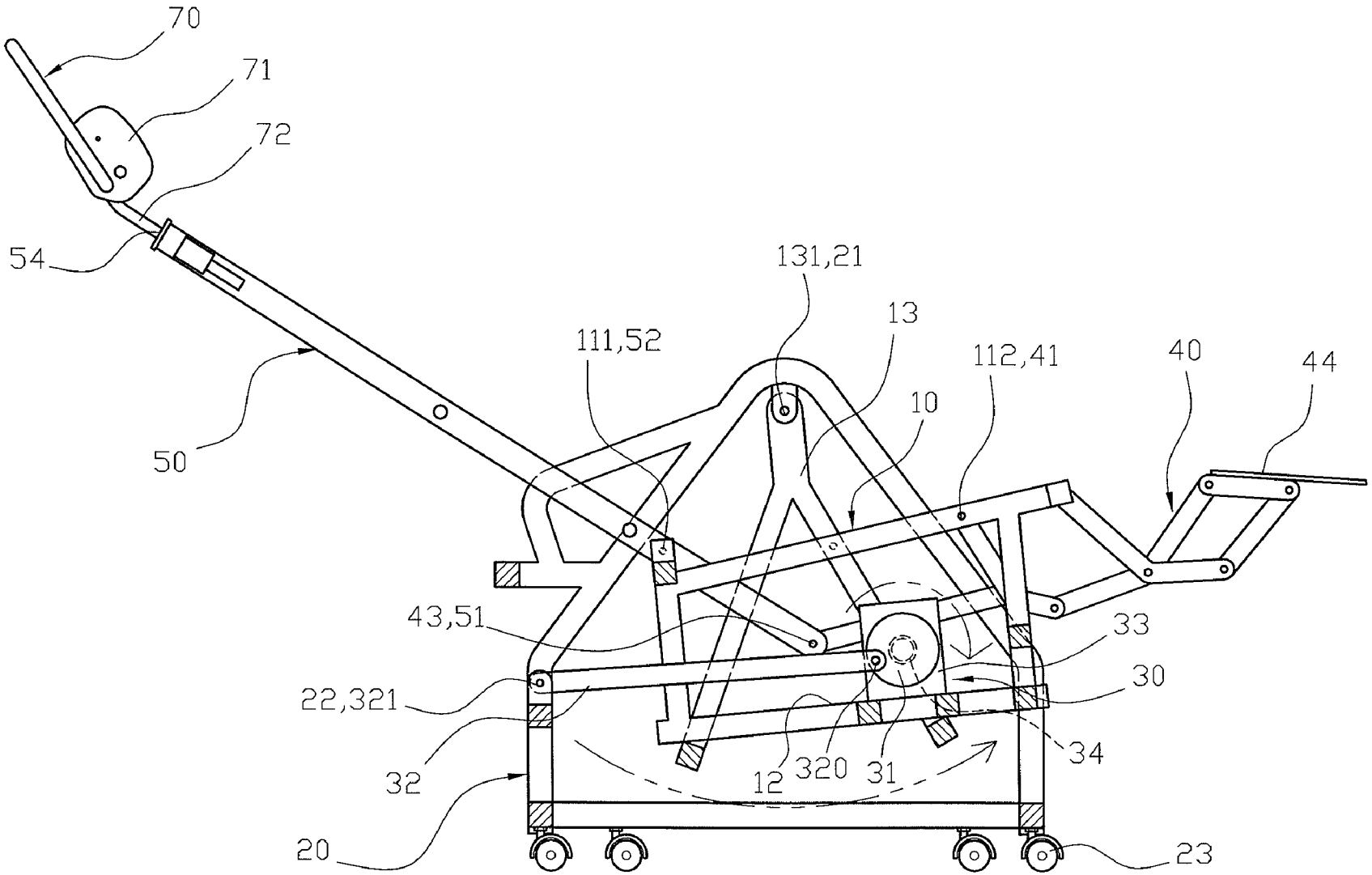
FIG. 8 is a schematic operational view of the motorized rocking chair as shown in FIG. 4.
Figure 9:
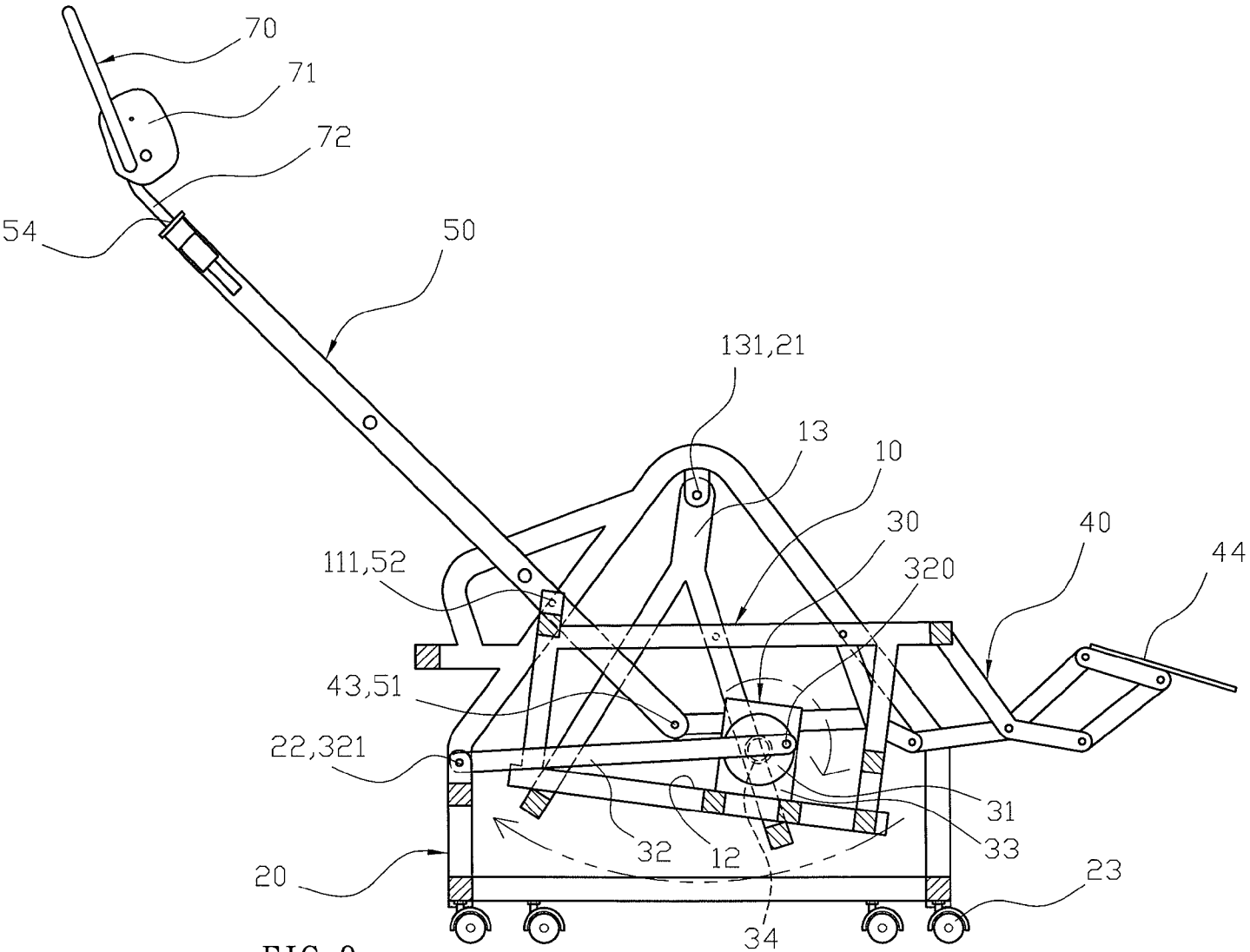
FIG. 9 is a schematic operational view of the motorized rocking chair as shown in FIG. 8.

In operation, referring to FIGS. 7-9 with reference to FIGS. 1-4, the drive member 33 of the actuating mechanism 30 is secured on the lower portion 12 of the seat 10, the first end 320 of the drive lever 32 is pivotally connected with and arranged on the rotation member 31 eccentrically, and the second end 321 of the drive lever 32 is limited by the stop portion 22 of the support frame 20, so that when the rotation member 31 is rotated by the drive member 33, the rotation member 31 is driven by the drive lever 32 to move relative to the support frame 20, and the drive member 33 is moved by the rotation member 31 to drive the seat 10 to move relative to the support frame 20. At this time, each of the two suspension arms 13 secured on the seat 10 is pivotally mounted on the support frame 20, so that the seat 10 is pivoted relative to the support frame 20 by operation of the actuating mechanism 30. In such a manner, the seat 10 is pivoted rightward as shown in FIG. 8 and leftward as shown in FIG. 9 so that the seat 10 is pivoted reciprocally relative to the support frame 20 in a pendulum manner.

Figure 10:
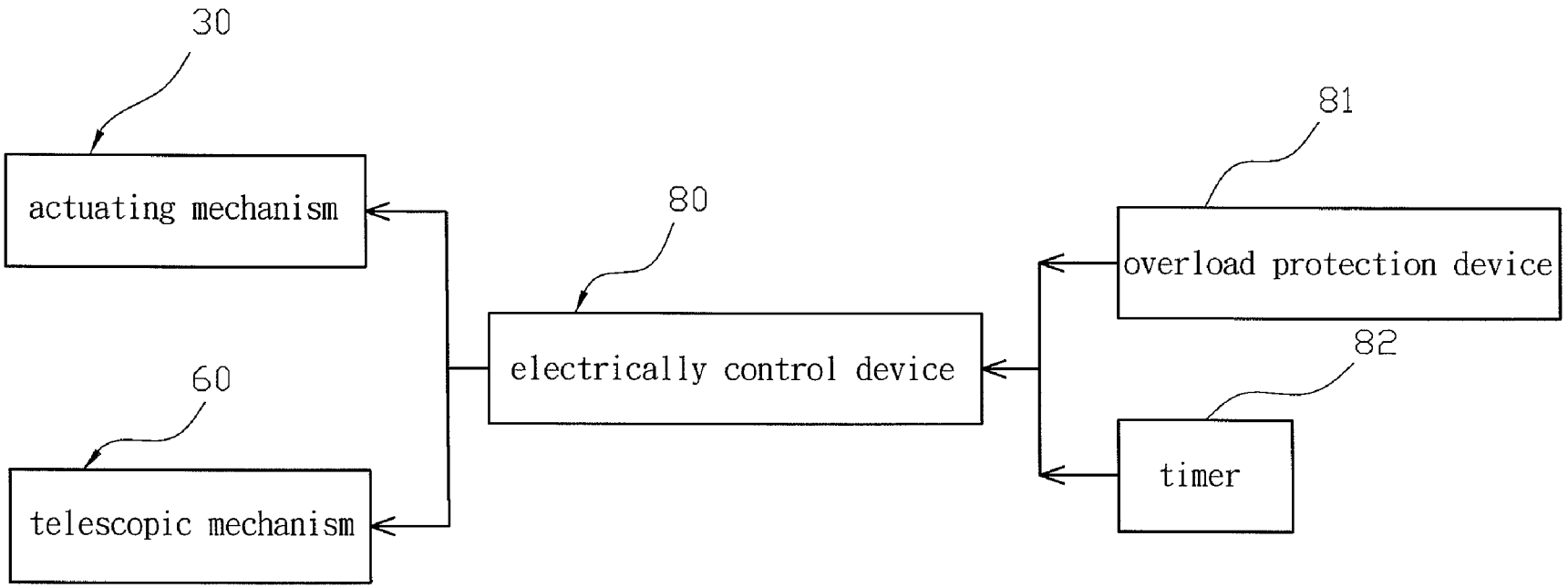
FIG. 10 is a schematic block diagram of the motorized rocking chair as shown in FIG. 1.

Referring to FIG. 10, the motorized rocking chair further comprises an electrically control device 80 connected with the actuating mechanism 30 and the telescopic mechanism 60 to control operation of the actuating mechanism 30 and the telescopic mechanism 60, an overload protection device 81 connected with the electrically control device 80 to shut an electric power to the electrically control device 80 when an overload occurs, and a timer 82 connected with the electrically control device 80 to automatically preset the operation time of the electrically control device 80. In such a manner, the telescopic mechanism 60 is controlled by the electrically control device 80 to adjust the inclined angle of the backrest 50 and the foot support 44, and the actuating mechanism 30 is controlled by the electrically control device 80 to drive the seat 10 to pivot relative to the support frame 20 in a pendulum manner.

Figure 12:
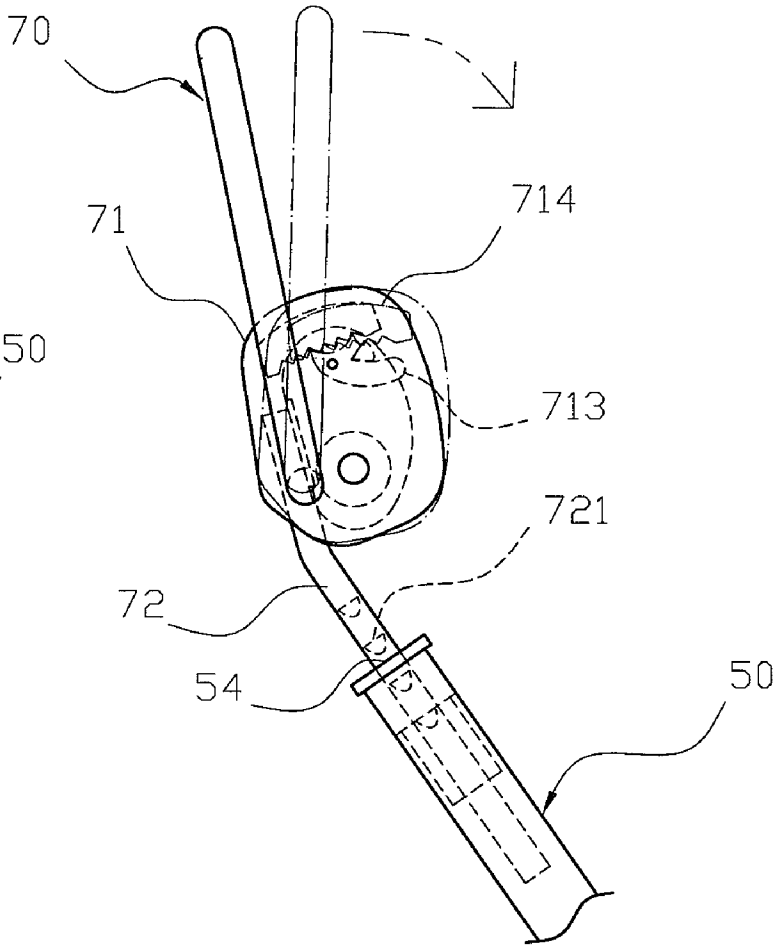
FIG. 12 is a side cross-sectional operational view of the motorized rocking chair as shown in FIG. 11.
Figure 11:
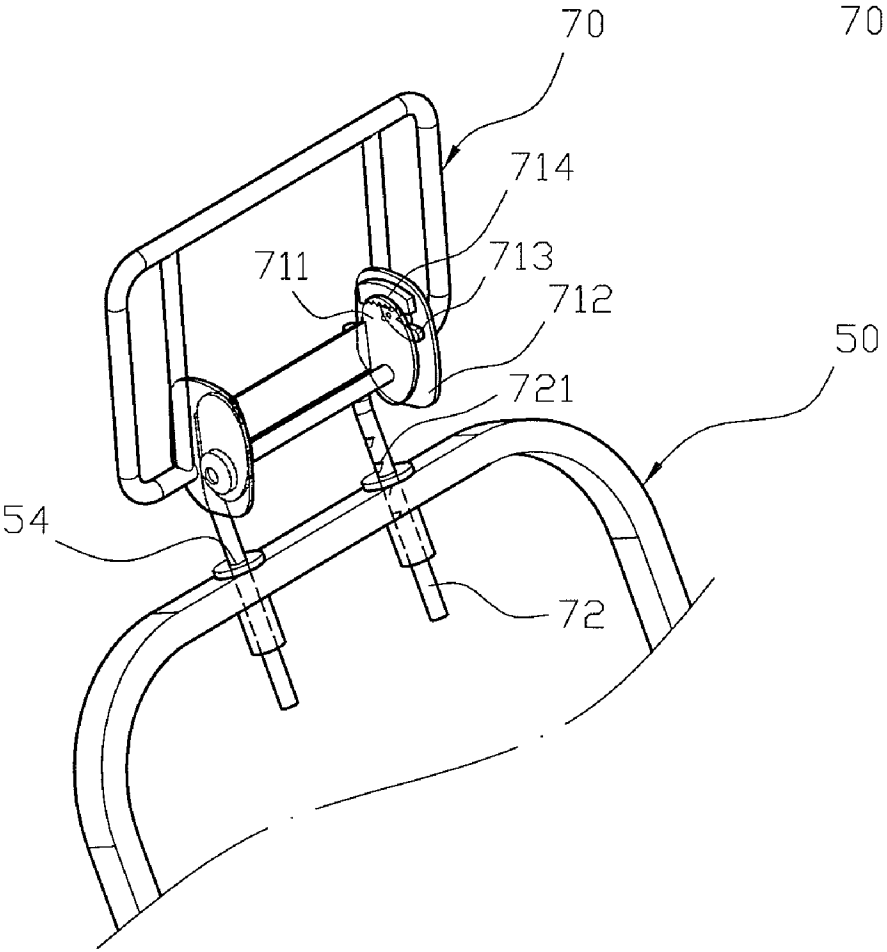
FIG. 11 is a partially perspective view of a motorized rocking chair in accordance with another preferred embodiment of the present invention.

Referring to FIGS. 11 and 12, the resting cushion 71 of the head support 70 includes a main adjusting bracket 711 and a secondary adjusting bracket 712 pivotally mounted on the main adjusting bracket 711. The main adjusting bracket 711 of the resting cushion 71 is provided with a main toothed portion 713. The secondary adjusting bracket 712 of the resting cushion 71 is provided with a secondary toothed portion 714 adjustably meshing with the main toothed portion 713 of the main adjusting bracket 711. Thus, the secondary adjusting bracket 712 of the resting cushion 71 is pivoted relative to the main adjusting bracket 711 of the resting cushion 71 to adjust the inclined angle of the head support 70. Each of the adjusting rods 72 of the head support 70 is provided with a plurality of adjusting detents 721 adjustably mounted in the respective mounting sleeve 54 of the backrest 50 to adjust the height of the head support 70.

Accordingly, the actuating mechanism 30 is controlled by the electrically control device 80 to drive the seat 10 to pivot relative to the support frame 20 reciprocally in a pendulum manner so that the seat 10 is pivoted relative to the support frame 20 automatically, and the user needs not to rock the seat 10 manually. In addition, the telescopic mechanism 60 is controlled by the electrically control device 80 to adjust the inclined angle of the backrest 50 and the foot support 44 according to the user's requirement so as to provide a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A motorized rocking chair comprising:

a support frame;

a seat pivotally mounted on the support frame;

an actuating mechanism mounted between the support frame and the seat to drive the seat to move relative to the support frame;

a backrest pivotally mounted on the seat;

a telescopic mechanism mounted between the seat and the backrest to drive the backrest to move relative to the seat;

two link mechanisms mounted at two opposite sides of the seat; and a foot support mounted between the two link mechanisms to move in concert with the two link mechanisms, wherein the seat has an upper portion which has a front end provided with two first through holes and second through holes and a rear end provided with two through bores;

each of the two link mechanisms has a mediate portion provided with a first pivot hole pivotally connected with a respective one of the first through holes of the seat and a second pivot hole pivotally connected with a respective one of the second through holes of the seat;

each of the two link mechanisms has a first end provided with a driven portion that is movable in concert with the backrest; and the backrest has a lower end provided with two pivot bores each pivotally connected with a respective one of the through bores of the seat and two push portions each pivotally connected with the driven portion of a respective one of the two link mechanisms.

2. The motorized rocking chair of claim 1, further comprising:

two suspension arms each secured on the seat and each pivotally mounted on the support frame.

3. The motorized rocking chair of claim 2, wherein the support frame has an upper end provided with two opposite pivot ears;

each of the two suspension arms extends upwardly from the seat and has an upper end provided with a pivot portion pivotally mounted on a respective one of the pivot ears of the support frame; and the seat is pivotable relative to the support frame in a pendulum manner.

4. The motorized rocking chair of claim 2, further comprising:

at least two reinforcing members located between the seat and the two suspension arms respectively.

5. The motorized rocking chair of claim 1, wherein the support frame has a rear end provided with a stop portion;

the actuating mechanism includes:

a drive member secured on a lower portion of the seat;

a rotation member rotatably mounted on the drive member; and a drive lever having a first end pivotally connected with the rotation member to move in concert with the rotation member and a second end pivotally connected with the stop portion of the support frame.

6. The motorized rocking chair of claim 5, wherein the drive member of the actuating mechanism is a drive motor to rotate the rotation member;

the rotation member of the actuating mechanism has a disk shape; and the first end of the drive lever is arranged on the rotation member eccentrically and is deviated from a central shaft of the rotation member.

7. The motorized rocking chair of claim 1, wherein each of the two link mechanisms has a second end provided with a support portion that is movable in concert with the driven portion; and the foot support is mounted between the support portions of the two link mechanisms.

8. The motorized rocking chair of claim 1, wherein the seat has lower portion provided with a support base;

the backrest has a side provided with a drive arm;

the telescopic mechanism has a first portion pivotally connected with the support base of the seat and a second portion retractably mounted in the first portion and pivotally connected with the drive arm; and when the second portion of the telescopic mechanism is moved relative to the first portion of the telescopic mechanism, the drive arm is moved in concert with the second portion of the telescopic mechanism to drive the backrest to pivot relative to the seat.

9. The motorized rocking chair of claim 1, further comprising:

an electrical control device connected with the actuating mechanism and the telescopic mechanism to control operation of the actuating mechanism and the telescopic mechanism.

10. The motorized rocking chair of claim 9, further comprising:

an overload protection device connected with the electrical control device to shut an electric power to the electrical control device when an overload occurs.

11. The motorized rocking chair of claim 9, further comprising:

a timer connected with the electrical control device to automatically preset the operation time of the electrical control device.

12. The motorized rocking chair of claim 1, further comprising: a head support mounted on the backrest.

13. The motorized rocking chair of claim 12, wherein the backrest has an upper end provided with two mounting sleeves; and the head support includes:

a resting cushion; and two adjusting rods each mounted on a bottom of the resting cushion and each adjustably mounted in a respective one of the two mounting sleeves of the backrest.

14. The motorized rocking chair of claim 13, wherein each of the adjusting rods of the head support is provided with a plurality of adjusting detents adjustably mounted in the respective mounting sleeve of the backrest to adjust the height of the head support.

15. The motorized rocking chair of claim 13, wherein the resting cushion of the head support includes:

a main adjusting bracket; and a secondary adjusting bracket pivotally mounted on the main adjusting bracket;

the main adjusting bracket of the resting cushion is provided with a main toothed portion; and the secondary adjusting bracket of the resting cushion is provided with a secondary toothed portion adjustably meshing with the main toothed portion of the main adjusting bracket.

16. The motorized rocking chair of claim 1, wherein the support frame has a lower end provided with a plurality of castors.

17. The motorized rocking chair of claim 1, wherein each of the two pivot bores of the backrest is located above each of the two push portions.

18. A motorized rocking chair comprising:

a support frame;

a seat pivotally mounted on the support frame;

an actuating mechanism mounted between the support frame and the seat to drive the seat to move relative to the support frame;

a backrest pivotally mounted on the seat; and a telescopic mechanism mounted between the seat and the backrest to drive the backrest to move relative to the seat, wherein the seat has lower portion provided with a support base;

the backrest has a side provided with a drive arm;

the telescopic mechanism has a first portion pivotally connected with the support base of the seat and a second portion retractably mounted in the first portion and pivotally connected with the drive arm;

when the second portion of the telescopic mechanism is moved relative to the first portion of the telescopic mechanism, the drive arm is moved in concert with the second portion of the telescopic mechanism to drive the backrest to pivot relative to the seat; and the drive arm has an upper end secured on the backrest and a lower end pivotally connected with the second portion of the telescopic mechanism.

* * * * *